US005209694A

United States Patent [19]

Utt, Jr.

[11] Patent Number: 5,209,694

[45] Date of Patent: May 11, 1993

[54] COMBINED FASHION DOLL AND DOLL SUPPORT

[76] Inventor: William W. Utt, Jr., 1719 Shenandoah Heights Rd., Front Royal, Va. 22630

[21] Appl. No.: 841,501

[22] Filed: Feb. 26, 1992

[51] Int. Cl.[5] ..... A63H 3/00

[52] U.S. Cl. ..... 446/73; 446/129; 446/268; 248/176; 248/206.5; 248/346

[58] Field of Search ..... 446/129, 268, 325, 396, 446/73, 72; 248/176, 206.5, 910, 346, 205.7; 220/603, 636, 737, 739

[56] References Cited

U.S. PATENT DOCUMENTS

| | | | |
|---|---|---|---|
| 2,771,219 | 11/1956 | Dewey | 248/346 X |
| 3,699,712 | 10/1972 | Handler et al. | 446/325 |
| 4,319,424 | 3/1982 | Goldfarb et al. | 446/268 |
| 5,024,611 | 6/1991 | Eckerle et al. | 446/268 |

*Primary Examiner*—Mickey Yu

[57] ABSTRACT

The invention provides, in combination, a fashion doll representing the human figure in a three dimensional form, and a doll support which receives the lower extremities of the doll and stabilizes the doll in an upright position. The doll support includes a tubular receptical portion to receive the doll and a base portion to stabilize the combination in an upright position. The tubular receptical portion is composed of a resilient material to minimize any risk of injury to the user.

5 Claims, 2 Drawing Sheets

COMBINED FASHION DOLL AND DOLL SUPPORT

FIELD OF THE INVENTION

The present invention relates to the field of childrens fashion dolls and devices that support them in an upright position. It is desirable that such devices are safe, inexpensive, and easy for small children to use.

BACKGROUND OF THE INVENTION

Presently there are devices available that support fashion dolls in an upright position. Most of these devices have been designed for display rather than for play of the dolls. If used for play, many of these devices present a hazard to the children using them.

Many children will engage in play with several fashion dolls at the same time, therefore cost is an important consideration.

Examples of such prior art devices can be found in U. S. Pat. Nos. 2,454,095, 2,527,152, 3,009,284, 3,516,632, 4,782,950. While these prior art devices do provide the desirable support for a fashion doll they are found to be dangerous, difficult for use by small children, and or relatively expensive.

SUMMARY OF THE INVENTION

It is an object of the present invention to provide a device in combination with a fashion doll that will support such a doll in an upright position, is safe, cost efficient and easy for a small child to use. The present invention includes a doll support that receives the lower extremities of the doll and provides a base of sufficient mass and dimension to stabilize the doll in an upright position. The doll support is comprised of resilient material to minimize the risk of injury to the user. The support may be manufactured as a one or two part device to facilitate manufacture in a cost efficient manner and for ease of storage by the user.

Additional features and advantages of the present invention will become apparent upon the reading of the following description in association with the accompanying drawings.

DETAILED DESCRIPTION OF THE DRAWINGS

Figure 1:
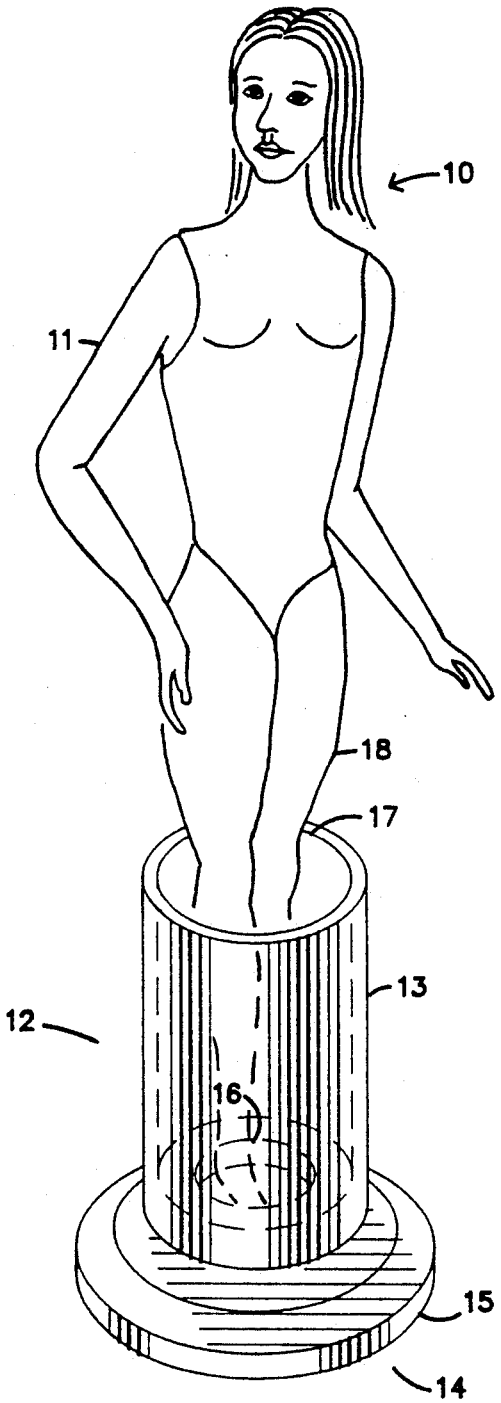
FIG. 1 is an isometric view of an embodiment of the support and doll combination according to the present invention.

A preferred fashion doll and doll support combination in accordance with the present invention is shown in FIG. 1 and is designated generally by numeral 10. The doll and doll support combination comprises a doll 11 and a doll support 12. The doll 11 is a commercially available type that represents the human figure in three dimensional form. The doll support 12 includes a tubular receptical portion 13 and a base portion 14. The tubular receptical portion 13 includes aperture 17. The aperture 17 receives and allows passage therethrough at least a portion of lower extremities 18 of the doll 11. Further, the tubular receptical portion 13 provides lateral stability, maintaining the doll 11 in an upright position when the combination 10 is placed on a horizontal surface, not shown. In this embodiment the base portion 14 and the tubular receptical portion 13 are manufactured as one piece from a resilient material. The base portion 14 includes flange 15 and optional recess 16. The flange 15 extends from the base generally perpendicular to the longitudinal axis of the tubular receptical. The mass of the base and the distribution of the mass in the flange provide sufficient moment of inertia, about axes transverse to the longitudinal axis of the tubular receptical portion 13, to resist overturning of the doll 11. The optional recess 16 locates the lower extremities 18 proximal the longitudinal axis of the tubular receptical 13. Optionally, the doll support 12 is comprised of a transparent material so as not to obstruct the view of the lower extremities 18.

Figure 2:
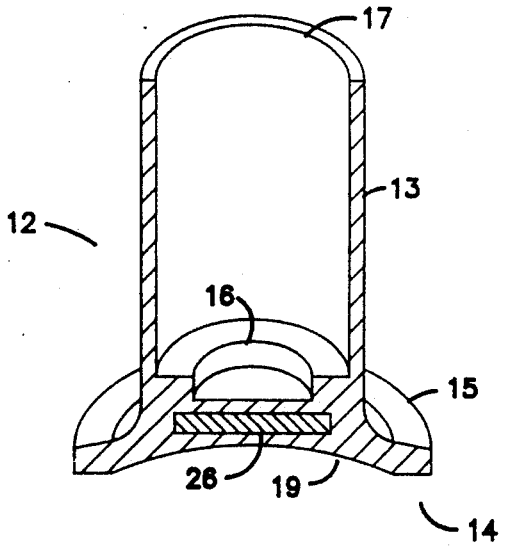
FIG. 2 is an isometric sectional view of an embodiment of the support shown in FIG. 1 according to the present invention.

FIG. 2 is an isometric sectional view of the doll support 12 shown in FIG. 1. Optional concaved surface 19 provides increased stability on an irregular surface and may function as a suction cup on a smooth flat surface, not shown, to anchor the doll support 12. Optionally the base 14 includes mass 26 of greater density than that of the remaining portion of the base 14 increasing the moment of inertia, about axes transverse to the longitudinal axis of the tubular receptical portion 13, to further resist overturning of the doll. Optionally mass 26 may be magnetized allowing the base 14 to be removably attached to a magnetic metal surface, not shown.

Figure 3:
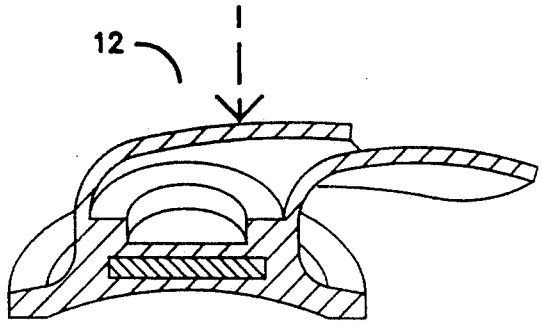
FIG. 3 is a sectional view of the embodiment of the support shown in FIG. 2 according to the present invention in a temporarily collapsed condition.

FIG. 3 is a sectional view of the doll support 12 shown in FIG. 2 according to the present invention. In this view the doll support 12 is shown collapsed, depicting how the resilient material of the doll support 12 will deform when subjected to an exterior force, indicated by arrow. The ability to collapse in this manner provides a safer article for use by children.

Figure 4:
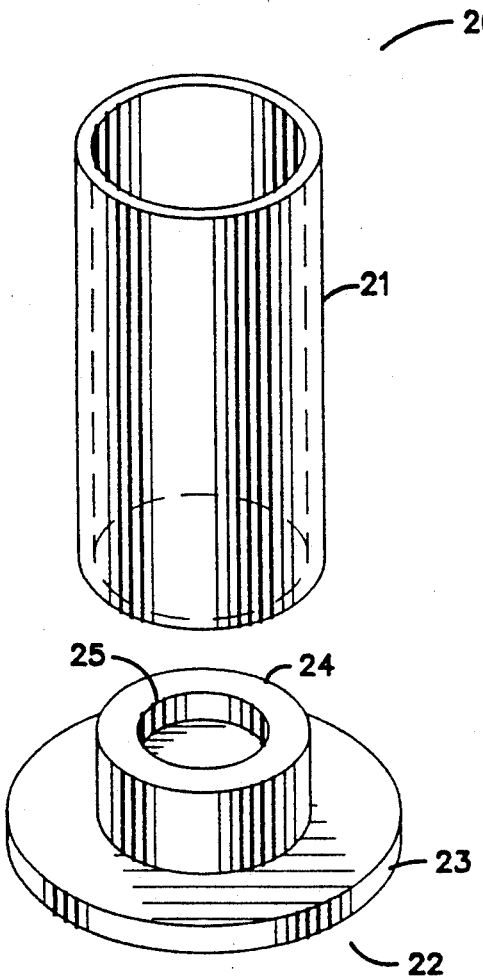
FIG. 4 is an exploded isometric view of an alternative embodiment of the support according to the present invention.
Figure 5:
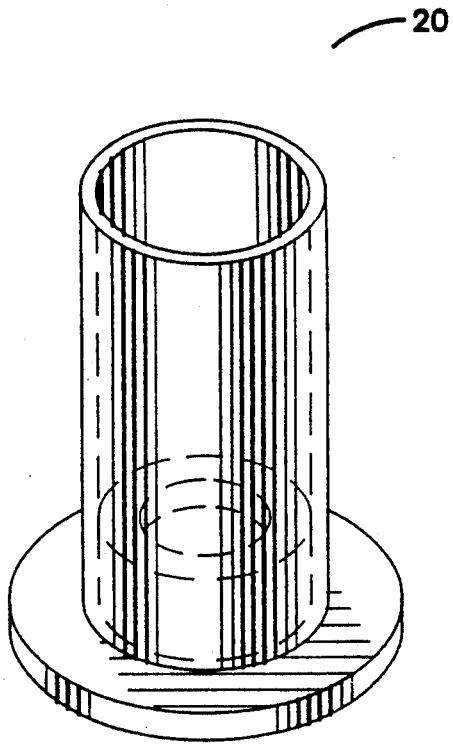
FIG. 5 is an isometric view of the alternative embodiment of the support shown in FIG. 4 according to the present invention.

FIG. 4 is an exploded isometric view of an alternative embodiment of the doll support 12, shown in FIG. 1, according to the present invention. In relation to the doll 11, doll support 20 functions in the same manner as the doll support 12 of FIG. 1. In this embodiment the doll support 20 comprises two components, tubular receptical 21 and base 22. Base 22 includes flange 23, projection 24 and optional recess 25. Tubular receptical 21 is comprised of a resilient material, and is optionally transparent. The base 22 is optionally comprised of a resilient material. The projection 24 receives and maintains the tubular receptical 21 in a position perpendicular to the base 22, as shown in FIG. 5. The optional recess 25 locates the lower extremities 18, shown in FIG. 1, proximal the longitudinal axis of the tubular receptical 21. Optionally the concaved surface 19 and the mass 26 shown in FIG. 2 may be incorporated into the base 22 and will function in the same manner as in FIG. 2.

FIG. 5 is an isometric view of the doll support 20 of FIG. 4 assembled for use. In relation to the doll 11 of FIG. 1, the doll support 20 functions in the same manner as the doll support 12 of FIG. 1.

While the embodiments of the invention described herein are at present the preferred and considered the most practical forms of the invention, it is to be understood that the invention is not limited to the disclosed embodiments, but may include other embodiments and variations of the disclosed embodiments that fall within the spirit and scope of the appended claims.

What is claimed is:

1. In combination:

[i] a doll representing the human figure in a three dimensional form, said doll comprising;

a body with upper extremities, lower extremities, and head attached, said doll having a maximum dimension of 15 inches;

[ii] a doll support comprising:

a tubular receptacle portion, said tubular receptacle portion having a first end and a second end, said first end including an aperture, said aperture adapted to receive and allow passage therethrough at least a portion of the lower extremities of said doll, said second end adapted to be mounted on a base portion, said tubular receptacle portion having an uninterrupted circumference and comprised of a resilient material; and said base portion extends from proximal said second end transverse to the longitudinal axis of said tubular receptacle portion to a base perimeter;

wherein said base portion has sufficient moment of inertia about axes transverse to said longitudinal axis to resist overturning of said doll.

2. A doll support as in claim 1, wherein said base portion includes a recess proximal said second end, said recess adapted to locate said lower extremities proximal said longitudinal axis of said tubular receptacle.

3. A doll support as in claim 1, wherein said base portion includes a cavity having an opening, said opening bounded by a sealing surface, said sealing surface proximal said base perimeter, said base portion comprised of a resilient material;

wherein said base portion may be detachably affixed to a smooth surface by placing said sealing surface against said smooth surface and deforming said base portion to reduce the volume of said cavity, wherein said resilient material rebounding will reduce the air pressure within said cavity, wherein ambient air pressure holds said base portion against said smooth surface.

4. A doll support as in claim 1, wherein said base portion includes a mass comprised of a material higher in density than that of the remaining base portion;

wherein said base portion having a greater moment of inertia about axes transverse to said longitudinal axis further resists overturning of said doll.

5. A doll support as in claim 4, wherein said mass is magnetic.

* * * * *